US008850659B2

(12) United States Patent
Ewing

(10) Patent No.: US 8,850,659 B2
(45) Date of Patent: Oct. 7, 2014

(54) TOP HUNG SLIDING PANEL APPARATUS AND METHOD

(75) Inventor: K. Brad Ewing, North Vancouver (CA)

(73) Assignee: K. Bradley Ewing, North Vancouver, British Columbia (CA)

( * ) Notice: Subject to any disclaimer, the term of this patent is extended or adjusted under 35 U.S.C. 154(b) by 0 days.

(21) Appl. No.: 13/288,330

(22) Filed: Nov. 3, 2011

(65) Prior Publication Data

US 2013/0111702 A1 May 9, 2013

(51) Int. Cl.
*E05D 15/06* (2006.01)

(52) U.S. Cl.
CPC ..... *E05D 15/0634* (2013.01); *E05Y 2201/628* (2013.01); *E05Y 2900/132* (2013.01); *E05D 15/0656* (2013.01); *E05Y 2201/638* (2013.01)
USPC ..... 16/91; 16/105; 16/97; 49/409

(58) Field of Classification Search
USPC ..... 16/94 R, 94 D, 95 R, 96 D, 97, 98, 105, 16/106, 107, 91; 160/196.1, 197, 199, 160/200, 201, 222, 223; 49/409, 425, 420, 49/421, 427
See application file for complete search history.

(56) References Cited

U.S. PATENT DOCUMENTS 1,042,927 A * 10/1912 King ..... 16/105
1,169,568 A * 1/1916 Richards ..... 16/105
1,191,334 A * 7/1916 Myers ..... 16/105
1,787,468 A * 1/1931 Bittorf et al. ..... 16/103
3,193,870 A * 7/1965 McNinch ..... 16/97
3,193,871 A * 7/1965 Foltz ..... 210/98
3,235,915 A * 2/1966 Glaser ..... 52/64
3,287,759 A * 11/1966 Foltz ..... 16/87 R
3,552,704 A * 1/1971 Pond ..... 248/342
3,602,150 A * 8/1971 Frost et al. ..... 104/172.4
3,661,431 A * 5/1972 Wisecarver ..... 384/55
3,708,827 A * 1/1973 Foltz ..... 16/98
3,757,384 A * 9/1973 Rusch ..... 16/97
3,793,673 A * 2/1974 Lawrence, Jr. ..... 16/97
3,813,728 A * 6/1974 Johnson ..... 16/97
3,829,929 A * 8/1974 Foltz et al. ..... 16/97
3,854,165 A * 12/1974 Haley ..... 16/96 R
4,134,176 A * 1/1979 Janson ..... 16/94 D
4,222,427 A * 9/1980 Buchner ..... 160/19
4,229,857 A * 10/1980 Toder ..... 16/95 R
4,372,006 A * 2/1983 Stratta et al. ..... 16/105
4,433,627 A * 2/1984 Forshee ..... 104/95
4,503,637 A * 3/1985 Parente ..... 49/141
4,513,535 A * 4/1985 Uphoff ..... 49/409
4,752,987 A * 6/1988 Dreyer et al. ..... 16/102
4,846,249 A * 7/1989 Cooper et al. ..... 160/345
4,852,628 A * 8/1989 Klein ..... 160/199

(Continued)

*Primary Examiner* — Victor Batson
*Assistant Examiner* — Jason W San
(74) *Attorney, Agent, or Firm* — John Russell Uren

(57) ABSTRACT

A hanger assembly for an architectural door or panel utilizes a head track connected to an overhead structural member with two concave tracks for receiving the convex wheel bearings which are attached to a hanger extending downwardly from the wheel bearings. The bottom of the hanger has a head which is inserted into a housing by way of an open groove. The housing is mounted to the frame of the door or panel. Rubber neoprene spacers are mounted between the head and the housing to adjust the vertical height of the door or panel relative to the head track and structural member. Additional wheel bearings may be added to the hanger as is necessary.

7 Claims, 3 Drawing Sheets

(56) References Cited

U.S. PATENT DOCUMENTS

| | | | | | |
|---|---|---|---|---|---|
| 5,090,171 | A * | 2/1992 | Kano et al. | 52/243.1 |
| 5,165,142 | A * | 11/1992 | Pilsbury | 16/90 |
| 5,542,149 | A * | 8/1996 | Yu | 16/87.4 R |
| 5,598,666 | A * | 2/1997 | Kurth | 49/409 |
| 5,970,578 | A * | 10/1999 | Mensching et al. | 16/94 R |
| 6,098,342 | A * | 8/2000 | Bischof et al. | 49/409 |
| 6,209,171 | B1 * | 4/2001 | Pelletier et al. | 16/97 |
| 6,336,247 | B1 * | 1/2002 | Schnoor | 16/87.6 R |
| 6,381,904 | B1 * | 5/2002 | Tedescucci | 49/409 |
| 6,463,625 | B2 * | 10/2002 | Mittag | 16/97 |
| 6,832,449 | B2 * | 12/2004 | Rennetaud et al. | 49/120 |
| 6,912,812 | B2 * | 7/2005 | Inage | 49/409 |
| 6,983,512 | B2 * | 1/2006 | De Oliveira | 16/97 |
| 7,117,559 | B1 * | 10/2006 | Barber | 16/97 |
| 7,392,747 | B2 * | 7/2008 | Ksyk | 104/96 |
| 7,712,258 | B2 * | 5/2010 | Ewing et al. | 49/410 |
| 7,743,557 | B2 * | 6/2010 | Liao | 49/409 |
| 7,891,052 | B2 * | 2/2011 | Haab et al. | 16/98 |
| 8,297,334 | B2 * | 10/2012 | Chu | 160/222 |
| 2009/0100760 | A1 * | 4/2009 | Ewing | 49/410 |
| 2010/0038041 | A1 * | 2/2010 | Liao | 160/196.1 |
| 2010/0269291 | A1 * | 10/2010 | Haab et al. | 16/91 |
| 2011/0162167 | A1 * | 7/2011 | Blais | 16/91 |
| 2011/0314634 | A1 * | 12/2011 | Liebscher et al. | 16/91 |
| 2012/0222267 | A1 * | 9/2012 | Desrosiers et al. | 16/82 |

* cited by examiner

TOP HUNG SLIDING PANEL APPARATUS AND METHOD

INTRODUCTION

This invention relates to a hanger assembly and, more particularly, to a hanger assembly for a sliding panel or door using a bearing assembly mounted within a head track which is mounted to the overhead structural member above the sliding door and to a housing operably connected to the door or panel and which utilises spacers to adjust the position of the panel relative to the structural member to ensure smooth and non-binding movement of the panel or door.

BACKGROUND OF THE INVENTION

Sliding doors or panels which are opened and closed by sliding within a groove or on a track and which are maintained in their generally vertical position during the sliding movement are ubiquitous in residential and commercial construction. However, disadvantages in the use and installation of such panels are well known. First, if the sliding members are heavy, hanging such members is difficult and two or more specialized installers may be required. Second, continued and proper adjustment of the sliding panels is important for proper operation of the panels or doors and, again, skilled labor may not be readily available to perform such adjustments. Third, the weight of such doors may act in an unbalanced way on the bearings if they are not precisely positioned. Thus, one set of bearings may receive more loading than a second set of bearings which affects the operation of the doors and the bearing life. Finally, subsequent service to the sliding members after installation typically requires a number of service personal to raise the doors off the track for cleaning, item replacement and the like. Thereafter, the panel members will require installation and adjustment. All of these attributes are unnecessarily expensive, time consuming and inconvenient for the user.

In a recent attempt to reduce the aforementioned problems, a wedge assembly was attached to the top of the panel or door member. A hanger extended downwardly from the wheel bearings. The hanger was shaped to be complementary to the wedge assembly and was inserted into a cavity within the wedge assembly. A threaded shaft extended through the hanger and rotated within a collar connected to the wedge assembly. By rotating the threaded shaft, the hanger would move relative to the wedge assembly thereby raising or lowering the panel or door relative to the wheel bearings. Such a configuration is disclosed in U.S. patent application Ser. No. 12/175,676 filed Jul. 18, 2008 and based upon provisional Ser. No. 60/951,180 filed Jul. 20, 2007, the contents of which are incorporated by reference.

While this configuration went some way towards solving the aforementioned problems, it gave rise to problems in production. The hanger was asymmetrical so machining was required. In addition, only a limited number of wheel bearing pairs could be used since the distance between the wheel bearings and the hanger bottom decreased over its length. Finally, the play created by moving the hanger within the wedge assembly was not great which called for more card in pre-adjusting the heavy door panels during the installation.

SUMMARY OF THE INVENTION

According to one aspect of the invention, there is provided apparatus for moving a hanging panel or door assembly comprising a head track operable to be securely mounted to an overhead structural member under which said handing panel or door assembly moves, at least one pair of wheel bearings mounted for movement within said head track, a hanger extending from said bearing assembly and having a head which is operably positioned within and movable relative to a housing, said housing being attachable to said panel or door assembly and spacers removably mounted between said head and said housing to allow adjustment of said head relative to said housing and therefore said door or panel relative to said at least one pair of wheel bearings.

According to a further aspect of the invention, there is provided a method of hanging a panel or door from an overhead structural member while allowing said panel or door to slide axially relative to said member, said method comprising hanging a head track from said overhead structural member, inserting at least one pair of wheel bearings with an attached hanger having a head portion into said head track, inserting said hanger and head portion into a housing which housing is securely mounted to a door or panel and inserting shims between said head portion and said housing to adjust the position of said housing and said door or panel relative to said at least one pair of wheel bearings.

BRIEF DESCRIPTION OF THE SEVERAL VIEWS OF THE DRAWINGS

Specific embodiments of the invention will now be described, by way of example only, with the use of drawings in which.

DESCRIPTION OF SPECIFIC EMBODIMENT

In this application, it is intended that the term "door" is intended to also refer to a "panel" or "panel member" and vice versa. The teachings of the invention are intended to cover both doors and panels and the terms are used interchangeably.

Figure 1:
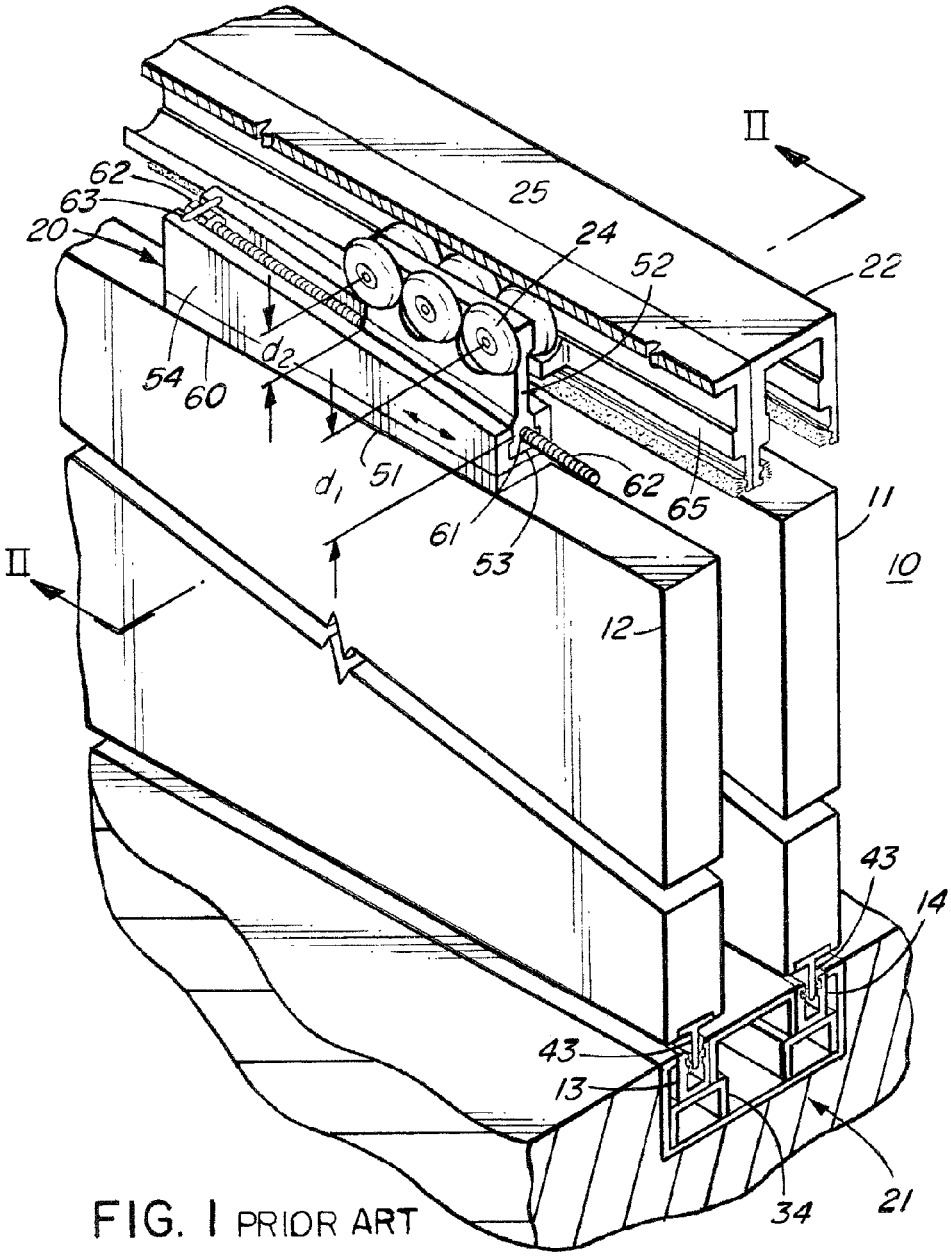
FIG. 1 PRIOR ART
FIG. 1 is a diagrammatic isometric and cutaway view of two (2) adjacent sliding doors or panels moving within adjacent drain tubes and which sliding doors are heavy from a bearing assembly utilising a sliding wedge adjustment mechanism according to the prior art.
Figure 2:
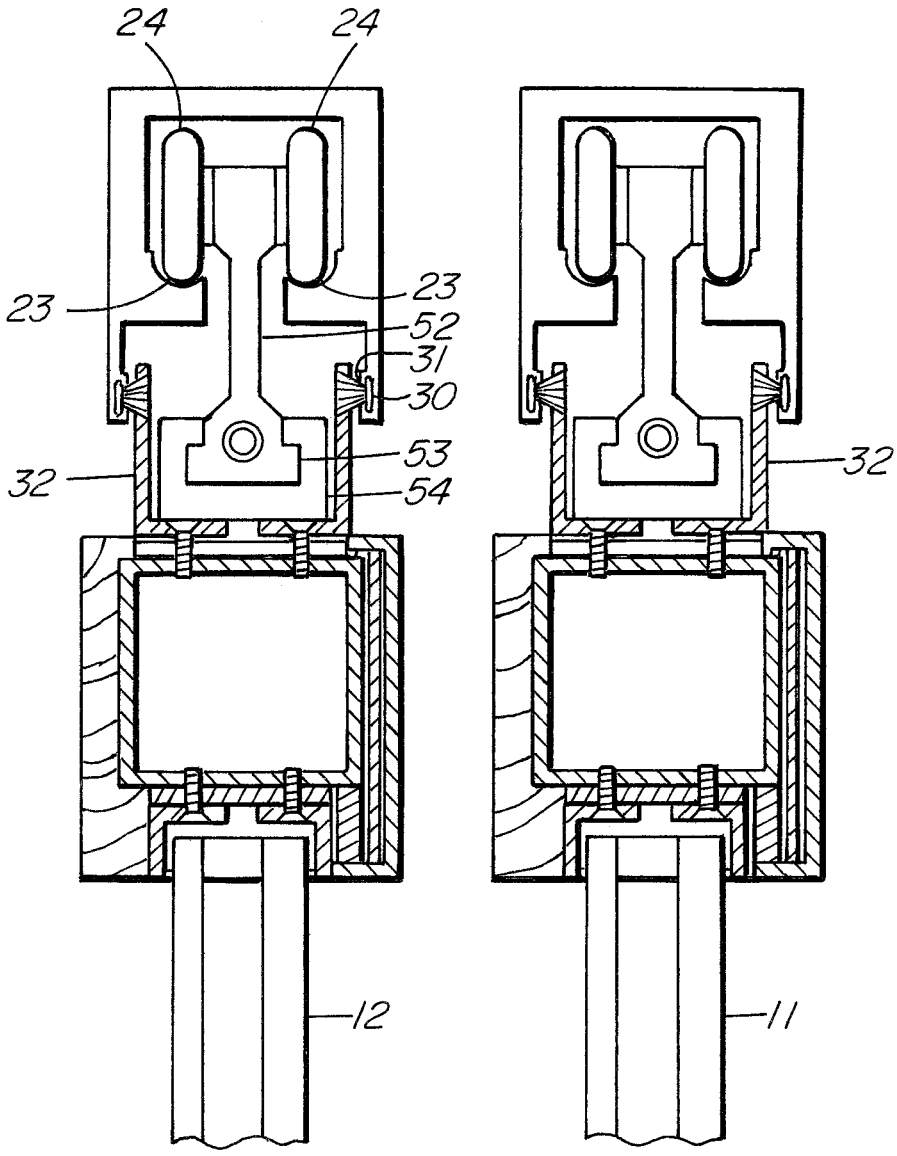
FIG. 2 PRIOR ART
FIG. 2 is a diagrammatic sectional view taken along II-II of FIG. 1.

Referring now to the drawings and, in particular, to FIGS. 1 and 2 which illustrate the prior art, two (2) doors or panel members 11, 12 are generally shown at 10 in FIG. 1. The first and second doors 11, 12, respectively, move within respective guide strips 13, 14 and are each hung from a pair of upper hanging assemblies, one such hanging assembly being generally illustrated in detail at 20. A lower guide or sill assembly is generally illustrated at 21, it being understood that the upper hanging assemblies 20 and the lower guide or sill assembly 21 are the same for each of the sliding doors 11, 12.

A support bracket conveniently in the form of an aluminum extrusion 22 is mounted on an upper structural member of the house or structure (not shown). The support bracket 22 includes two (2) concave bearing guide paths 23 (FIG. 2) to allow the rotating bearings 24 of the bearing assembly 20 to move therein. The support bracket 22 also conveniently includes brush housings 30 which hold removable mohair brushes 31 used to provide a brushing action against the top frame member 32 of door 11 thereby to prevent the ingress of water and debris and to remove loose foreign material from the frame member 22 during movement of the door 11.

The bearing assembly generally illustrated at 25 includes the rotatable bearings 24 which are heavy duty and may utilise a TEFLON (Trademark) polytetrafluorethylene material in order to reduce the friction between the bearings 24 and the bearing guide paths 23 when the bearings 24 are moving within the guide paths 23. There are three (3) pairs of wheel bearings 24 shown. They rotate about respective axes 51 (FIG. 1). Bearings 24 are connected on each side of the hanger 52 which extends downwardly and centrally between the bearings 24 thereby to reduce or eliminate any moment acting on the bearings 24 by the hanging panels 11, 12 which are each connected to a respective hanger 52.

Hanger 52 terminates in an enlarged male member 53 which is mounted for reciprocal and longitudinal movement within a wedge member 54. The hanger 52 extends downwardly from the forward most bearing 24 as viewed in FIG. 1 a distance "d1" which distance "d1" is longer than the distance "d2" from the rearward one of the bearings 24 as also seen in FIG. 1. The slope between the two distances d1, d2 matches the slope of a wedge member 54 in which the male member 53 moves. Wedge member 54 is connected to an anchor plate 60 (FIG. 1) which anchor plate 60 is mounted to the top of each door or panel 11, 12. Wedge member 54 therefore moves with door or panel 11 and anchor plate 60 and remains stationary relative to the door 11 and anchor plate 60.

A threaded hole 61 extends through the male member 53 of hanger 52 and a threaded bolt 62 is threadedly connected through a hole (not illustrated). A socket (not illustrated) at the end of the threaded bolt 62 allows a tool (not shown) to rotate the bolt 62. The bolt 62 is held by a collar 63 stationary within wedge member 54. Collar 63 allows the bolt 62 to rotate freely within the threaded hole 61 of wedge member 54 thereby drawing the hanger assembly 25 along the wedge member 54 which, because of the connection between the wedge member 54 and anchor plate 60 to the door 11, allows the panel member or door 11 to be moved upwardly and downwardly relative to the door bearing assembly 25 and the support bracket 22 as the installation may require in order that the door 11 hangs cleanly and moves freely.

A recess 65 is provided in the support bracket or aluminum extrusion 22 at the end of the bracket 22 mounted in the frame of the moving panels 11, 12 (FIG. 1). It will be understood that a further and second recess 64 is provided at the opposite end of the support bracket 22 which is not illustrated in FIG. 1. The recess 65 is formed by cutting away material previously forming the bearing guide paths 23 formed on either side of the longitudinal axis of the bracket 22. By removing the guide path material to form the recess 65, the bearing assembly 25 may be inserted into the support bracket 22 and the bearings 24 can then move freely on the bearing guide paths 23. To prevent the bearings 24 from moving into the recess 65 during sliding movement and operation of the door 11, the wedge member 54 and anchor plate 60 are mounted to the door 11 at a position where, with the door 11 in its limiting positions of movement within lower drain tube 33 and upper support bracket 22, the bearings 24 remain a distance away from the recess 65 thereby avoiding any unnecessary stress in the bearing guide paths 23 adjacent the recess 65 and thereby avoiding the recess 65 entirely.

It will be seen by the aforementioned description of the prior art drawer hanger, that although raising or lowering the doors or panels 10, 11, the wedge member 54 and its associated components do have disadvantages inherent in the design. First, the number of bearings 24 is limited due to the decrease in distance between the axes 51 of the bearings 24 and the bottom 55 of the hanger 52 decreasing as one proceeds from front to back as exemplified by distances "$d_1$" and "$d_2$". This necessarily limits the number of wheel pairs which may be installed on the hanger 52. This deficiency may adversely affect the loading on the support bracket 22 and may also result in uneven loading across the top distance of the door or panel 11, 12. Further, since the hanger 52 is asymmetrical, the hanger 52 must be machined and not extruded which significantly increases manufacturing costs. A further disadvantage is that the male member 53 is mounted in a metal to metal relationship with the wedge and door panel 11, 12. The vibrations caused by the bearings 24 moving in the concave tracks 23 are transferred to the door panels 11, 12 which may create noise and rumble sounds and uneven forces.

Figure 3:
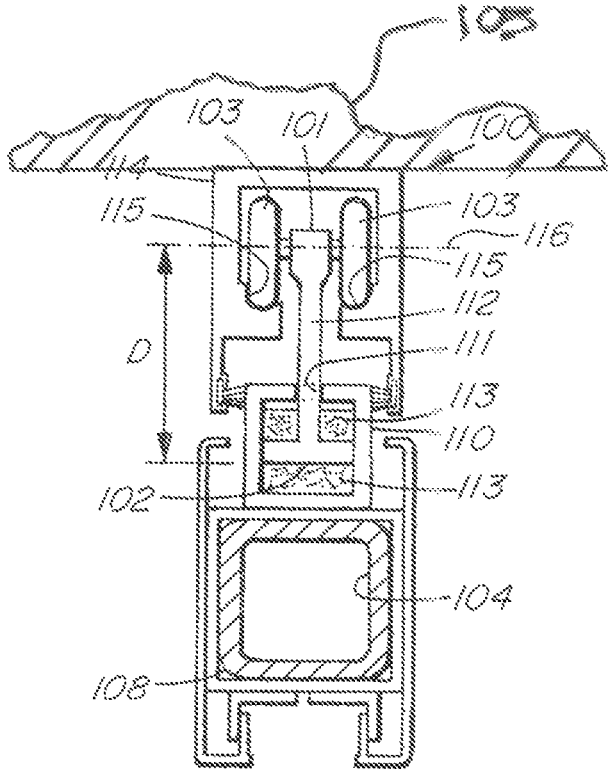
FIG. 3 is a sectional view of the hanger assembly according to the invention.
Figure 4:
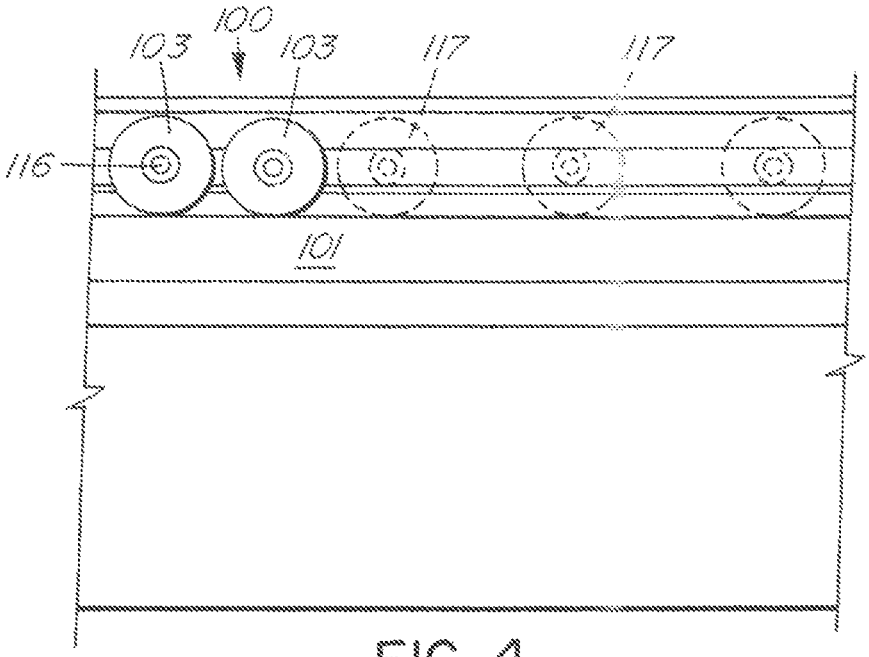
FIG. 4 is a side view of the bearing assembly of FIG. 3 according to the present invention, particularly showing the symmetrical configuration of the hanger with optionally added wheel bearings shown in dashed lines.

The hanger assembly according to the present invention is generally illustrated at 100 in FIGS. 3 and 4. It comprises the hanger 101 having a T-shaped head portion 102 and a first and second pair of wheel bearings 103 mounted to the hanger 101. It further includes a head track 114 which is rigidly and securely mounted to the overhead structural member 105 in which the door or panel 108 is to be installed and operated. The head track 114 contains two tracks 115, one for each of the wheel bearings 103. The tracks 115 have a concave shape to receive the convex outer circumference of the wheel bearings 103.

The door frame 104 encircles the door or panel 108. The door or panel 108 is large and is made from a strong material, conveniently steel or aluminum although other materials such as an appropriate carbon fiber plastic, could also be used. The door or panel 108 is also heavy. The reason this is so is that the doors or panels 108 intended to be used particularly advantageously with the present invention are architectural doors or panels which are typically exposed to weather conditions outside the door or panel 108 and they are further intended to be used on expensive homes or buildings where the sliding doors or panels 108 may be opened in good weather and closed under poor weather conditions. The doors or panels 108 must be robust in construction to provide structural integrity and also to operate flawlessly when opened or closed under adverse weather conditions.

The door frame 104 is attached to a housing 110, conveniently made from aluminum, which runs over at least a partial length of the top of door or panel 108. The housing 110 is attached by bolts or screws as is known. An open groove 111 is formed in the top of the aluminum housing 110 and extends a predetermined length along the top of the housing 110. The width of the groove 111 is such that the intermediate portion 112 of hanger 101 can be inserted into the groove 111 from one end of the housing 110 until its predetermined position is reached.

The T-shaped head 102 of hanger 101 will be entirely within the housing 110. A series of spacers 113, conveniently made from neoprene rubber although other materials are also contemplated, are positioned on top of and below the T-shaped head 102 and extend along the length of the hanger assembly 100. The spacers 113 maintain the T-shaped section 102 at a generally uniform position within the housing 110 and which may be adjusted as will be explained in greater detail hereinafter.

Several characteristics of the hanger assembly 100 are noteworthy. First, reference is made to FIG. 3 where the distance "D" is noted as being the distance between the axis 116 of the wheel bearings 103 and the bottom of the T-shaped member 102. This distance "D" remains uniform through the length of the hanger assembly 100 as opposed to decreasing in distance as in the PRIOR ART embodiment illustrated in FIG. 1. This uniform distance "D" allows the addition of as many pairs of wheel bearings 103 (FIG. 4) as is deemed necessary in order to properly and uniformly support the weight of the door or panel 108 and to reduce the concentrated loading on the structural head member (not illustrated) to which the head track 114 is connected. This is isometrically illustrated by the dashed wheels 117 of FIG. 4. In the embodiment of FIG. 1, the number of wheel pairs is limited by the decreasing distance of the hanger bottom from the axes of the wheel bearings.

Second, the uniform distance "D" of the hanger assembly 100 allows the hanger 101 to be extruded. Machining is not necessary as was the case with the hanger of FIG. 1.

Thirdly, the use of spacers 113, conveniently neoprene rubber shims between the T-shaped head 102 and the top and bottom of the housing 110 provides a dampening and quieting effect on shocks or forces which are incurred during operation. The forces are smoothly absorbed and dissipated by the spacers 113 which provides an even shock-free movement of the door or panel 108 as it moves in a reciprocal fashion on the head track 114.

Fourthly, the use of spacers 113, particularly rubber spacers, thermally isolates the housing 110 connected to the door 108 and, therefore, the wheel bearings 103 from the door 108.

Fifthly, there is increased height adjustment available with the spacer-head member configuration. The adjustment distance is considerably greater than in almost any other architectural door. This is advantageous when attempting to initially install the door onto the head track.

Sixthly, following installation, there are no mechanical mechanisms required. Thus, there are no mechanical components to fail or corrode or require adjustment.

Operation

In operation, the housing 110 will be mounted to the top of the door or panel frame 104 as is illustrated in FIG. 3. The weight of the door or panel 108 and the length and the position top of the aluminum housing 110 are known. These figures will dictate the length and the position of the hanger assembly 100 and the number of wheel bearings 103 which ought to be used for the hanger assembly 100 based on the load and weight of the door or panel 108.

The door or panel 108 with the attached housing 110 will then be manually positioned in its operating position under the overhead structural member where the head track 114 is positioned. The doors 108 are heavy which means the manual positioning may involve more than one individual who raise the door or panel 108 into its desired and correct operating position and maintain it in its desired operating position by supports, jacks or the like while installation takes place. The hanger assembly 100 will be inserted into the head track 114 and the wheel bearings 103 will be positioned within the concave grooves 111 with the desired number of wheel bearings 103 connected to the hanger 101 as has been calculated.

The hanger 101 is further inserted into the groove 111 of the housing 110 to its desired position. Further spacers (not illustrated) may be inserted into the housing 110 both before and after the hanger 101 to hold it in position during operation, these spacers being metal spacers which fill the inner space of housing 110 to prevent relative movement between the hanger assembly 100 and the housing 110.

With the hanger assembly 100 located at its desired operating location, the rubber shims or spacers 113 are inserted throughout the length of the hanger assembly 100 and between the T-shaped head portion 102 and the housing 110 until the desired vertical position of the door or panel 108 is realized. The head track 110 is then closed with a closure member or insert to prevent any movement of the hanger 101 and wheel bearings 103 beyond what is required for complete movement of the door or panel 108.

The interim supports (not shown) for the door or panel 108 are carefully removed and the entire weight of the door or panel 108 then rests on the hanger 101 and the wheel bearings 103 which bear on the concave tracks 115 within the head track 114. The assembly of the door or panel 108 within the head track 114 is complete.

Many modifications will readily occur to those skilled in the art to which the invention relates and the particular embodiments herein described should be taken as illustrative of the invention only and not as limiting its scope as defined in accordance with the accompanying claims.

I claim:

1. An apparatus for moving a hanging panel or door assembly comprising a head track operable to be securely mounted to an overhead structural member under which said hanging panel or door assembly moves, at least one pair of wheel bearings forming a bearing assembly mounted for movement within said head track, a hanger extending from said bearing assembly and having a head which is operably positioned within and movable relative to a housing, said housing being attachable to said panel or door assembly and spacers removably mounted between said head and said housing to allow adjustment of the relative position of said head relative to said housing by varying the number of spacers.

2. The apparatus as in claim 1 wherein the wheel bearings have an axis and wherein the hanger has a length and wherein the vertical distance between said head of said hanger and said axis of said wheel bearings is substantially constant throughout said length of said hanger.

3. The apparatus as in claim 2 wherein said head track has a pair of concave tracks and wherein said wheel bearings have a convex circumference, said wheel bearings being operably mounted for movement within said tracks.

4. The apparatus as in claim 3 wherein said hanger is an extrusion.

5. The apparatus as in claim 4 wherein said housing has an open groove operable to allow the insertion of said hanger and said head into said housing.

6. The apparatus as in claim 5 wherein said spacers are neoprene rubber material.

7. A method of hanging a panel or door from an overhead structural member while allowing said panel or door to slide axially relative to said member, said method comprising hanging a head track from said overhead structural member, inserting at least one pair of wheel bearings with an attached hanger having a head portion into said head track, inserting said hanger and head portion into a housing, which housing is securely mounted to a door or panel and inserting or removing shims mounted between said head and said housing to allow adjustment of the relative position of said head relative to said housing by varying the number of shims.

* * * * *